US009552943B2

(12) United States Patent
Gerving et al.

(10) Patent No.: US 9,552,943 B2
(45) Date of Patent: Jan. 24, 2017

(54) SWITCHING DEVICE WHICH IS SUITABLE FOR DC OPERATION

(71) Applicants: Karsten Gerving, Bonn (DE); Volker Lang, Bonn (DE); Johannes Meissner, Bonn (DE); Ralf Thar, St. Augustin (DE)

(72) Inventors: Karsten Gerving, Bonn (DE); Volker Lang, Bonn (DE); Johannes Meissner, Bonn (DE); Ralf Thar, St. Augustin (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 0 days.

(21) Appl. No.: 14/366,032

(22) PCT Filed: Dec. 12, 2012

(86) PCT No.: PCT/EP2012/075264
§ 371 (c)(1),
(2) Date: Jun. 17, 2014

(87) PCT Pub. No.: WO2013/092348
PCT Pub. Date: Jun. 27, 2013

(65) Prior Publication Data

US 2015/0129548 A1 May 14, 2015

(30) Foreign Application Priority Data

Dec. 22, 2011 (EP) ..... 11195174

(51) Int. Cl.
*H01H 33/10* (2006.01)
*H01H 33/18* (2006.01)
(Continued)

(52) U.S. Cl.
CPC ..... *H01H 33/10* (2013.01); *H01H 9/36* (2013.01); *H01H 9/443* (2013.01); *H01H 9/46* (2013.01);
(Continued)

(58) Field of Classification Search
CPC ..... H04H 9/46; H04H 9/44; H04H 9/36; H04H 33/20; H04H 33/187; H04H 33/596; H04H 33/10; H04H 33/42; H04H 33/185; H04H 3/02; H04H 3/08; H04H 3/34; H04H 75/00; H04H 53/00; H04H 73/045; H04H 9/443
(Continued)

(56) References Cited

U.S. PATENT DOCUMENTS 5,004,874 A * 4/1991 Theisen et al. ..... 218/151
5,130,504 A * 7/1992 Moldovan et al. ..... 218/40
(Continued)

FOREIGN PATENT DOCUMENTS

DE 1946065 U 9/1966
DE 1515978 B1 2/1970
(Continued)

OTHER PUBLICATIONS

Partial translation of FR1522714 (org. doc. published Apr. 26, 1968).*

*Primary Examiner* — Renee Luebke
*Assistant Examiner* — William Bolton
(74) *Attorney, Agent, or Firm* — Leydig, Voit & Mayer, Ltd.

(57) ABSTRACT

A switching device suitable for DC operation includes at least a pair of contacts having a first and second contact, wherein at least one of the two contacts is mobile and the two contacts are in contact with one another in a switched-on state and are not in contact with one another in a switched-
(Continued)

off state, having an arc driver arrangement which generates a magnetic field at least in the region of the pair of contacts, and comprising a first arc guiding arrangement by which an arc which is produced between the contacts is guided in a first current direction to a quenching device for quenching the arc, wherein a second arc guiding arrangement is provided, by means of which an arc which is produced between the contacts is guided in a second current direction, which is opposite the first current direction, to said quenching device for quenching the arc.

20 Claims, 3 Drawing Sheets

(51) Int. Cl.

| | |
|---|---|
| ***H01H 33/42*** | (2006.01) |
| ***H01H 9/36*** | (2006.01) |
| ***H01H 9/44*** | (2006.01) |
| ***H01H 9/46*** | (2006.01) |
| ***H01H 73/04*** | (2006.01) |

(52) U.S. Cl.
CPC ..... *H01H 33/185* (2013.01); *H01H 73/045* (2013.01)

(58) Field of Classification Search
USPC ..... 218/23, 24, 26, 30, 34, 36, 40, 81, 148, 218/149
See application file for complete search history.

(56) References Cited

U.S. PATENT DOCUMENTS

| | | | | |
|---|---|---|---|---|
| 5,138,122 | A * | 8/1992 | Moldovan et al. | 218/22 |
| 5,818,003 | A * | 10/1998 | Moldovan et al. | 218/26 |
| 2009/0127229 | A1 | 5/2009 | Schmitz et al. | |
| 2012/0145675 | A1* | 6/2012 | Zhou et al. | 218/150 |

FOREIGN PATENT DOCUMENTS

| | | | | |
|---|---|---|---|---|
| DE | 1640804 | A1 | 12/1970 | |
| DE | 7835288 | U1 | 3/1979 | |
| EP | 0789372 | B1 | 8/1997 | |
| EP | 2061053 | A2 | 5/2009 | |
| FR | 1522714 | * | 4/1968 | H01H 9/443 |
| FR | 2441915 | A1 | 6/1980 | |
| WO | WO9921201 | * | 4/1999 | H01H 9/30 218/22 |

* cited by examiner

SWITCHING DEVICE WHICH IS SUITABLE FOR DC OPERATION

CROSS-REFERENCE TO RELATED APPLICATIONS

This application is a U.S. National Stage Application under 35 U.S.C. §371 of International Application No. PCT/EP2012/075264 filed on Dec. 12, 2012, and claims benefit to European Patent Application No. EP 11195174.5 filed on Dec. 22, 2011. The International Application was published in German on Jun. 27, 2013, as WO 2013/092348 A1 under PCT Article 21(2).

FIELD

The invention relates to a switching device suitable for direct current operation, which includes at least one contact pair with a first contact and a second contact, at least one of the two contacts being movable and the two contacts being in contact with one another in a switched on condition of the switching device and out of contact in a switched off condition of the switching device.

BACKGROUND

Such a switching device is known from EP2 061 053 A2. For creating a switching device for direct current applications, it is recommended that the housing of a switching device for alternating current applications be used, where at least one additional magnet is provided for creating a magnetic field with field lines predominantly transverse to the isolation gaps of current paths of the alternating current switching device. There are three receiving regions in the housing for each single current path, where each current path is assigned a movable switching contact element as well as two fixed switching contact elements opposite to each other. The three movable switching contact elements can be moved together, between a closed position which corresponds to the switched-on state of the switching device, and an open position which corresponds to a switched-off state of the switching device. The individual current paths are each assigned two arc extinguishing devices in the form of extinguishing plates, arranged over one another and electrically isolated from each other. In addition, when the movable switching contact elements are open, each current path has two isolation gaps which form between the ends of the movable switching elements and the first and second fixed switching elements which are allotted to the ends of the movable switching contact elements. On opening of the switching contact elements, an arc which can be extinguished with the help of arc extinguishing devices is formed along isolation gaps. Since arcs in direct current applications cannot be extinguished during zero current passing as in alternating current applications, a magnetic field that drives the arc into an arc extinguishing device has to be used in direct current applications. This magnetic field is built up by permanent magnets, where a magnetic field is built up with field lines in a direction which runs transverse to the isolation gaps and creates a Lorenz force on the arcs that form along these separation sections which drives an arc in the direction of an arc extinguishing device. In this context, an arc between a first contact pair is driven in the direction of a first arc extinguishing device and the arc between a second contact pair is driven in the direction of the second arc extinguishing device. Since the movement of the arcs is dependent on the direction of the current, the switching device is only suitable for one current direction, i.e. polarity. If the switching device is operated in the opposite current direction, the arcs will not be driven into the arc extinguishing devices but in the opposite direction to a switching bridge. Even if the magnetic polarity of one of the arc extinguishing devices is reversed, one of the arcs would run towards a switching bridge, which would result in reduced lifetime, since the switching bridge or other part would be damaged or even destroyed in the long run.

The EP 0 789 372 B1 also shows a switching device of the type mentioned at the outset. A fixed contact is provided with a fixed arc runner which is circular arc-shaped. A movable arc runner is provided on a movable contact, where an arc can form between the two arc runners, which can be moved in different directions by the arc driver assembly in accordance with the direction of the current. In accordance with the direction of current, this is diverted around a centre point, either in the first direction of rotation or in a second direction of rotation opposite to the first, where the centre point corresponds to the centre point of the fixed arc runner. An arc with the first direction of current is diverted into a first arc runner channel and an arc with a direction of current opposite to the first direction of current is diverted into the second arc runner channel. Both arc runner channels run around the centre point and are arranged next to each other separated by an insulating wall. The arc runner channels are part of an extinguishing device for extinguishing the arc. Furthermore, the extinguishing devices comprise extinguishing plates which are radially oriented to the stationary arc channels. The extinguishing plates are arranged in such a way that they cover both the arc channels and, therefore, are part of both extinguishing devices.

SUMMARY

An aspect of the invention provides a switching device for direct current operation, the switching device comprising: a contact pair including a first contact and a second contact, wherein at least one of the two contacts is movable, and the two contacts are in contact with each other in the switched-on state of the switching device and the two contacts are not in contact with each other in the switched-off state of the switching device; an arc driver assembly configured to generate a magnetic field at least in an area of the contact pair; a first arc guiding arrangement configured to drive an arc generated between the first and second contacts with a first current direction toward an extinguishing device configured to extinguish the arc; and a second arc guiding arrangement configured to drive an arc generated between the first and second contacts with a second current direction which is opposite to the first current direction, to the extinguishing device.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
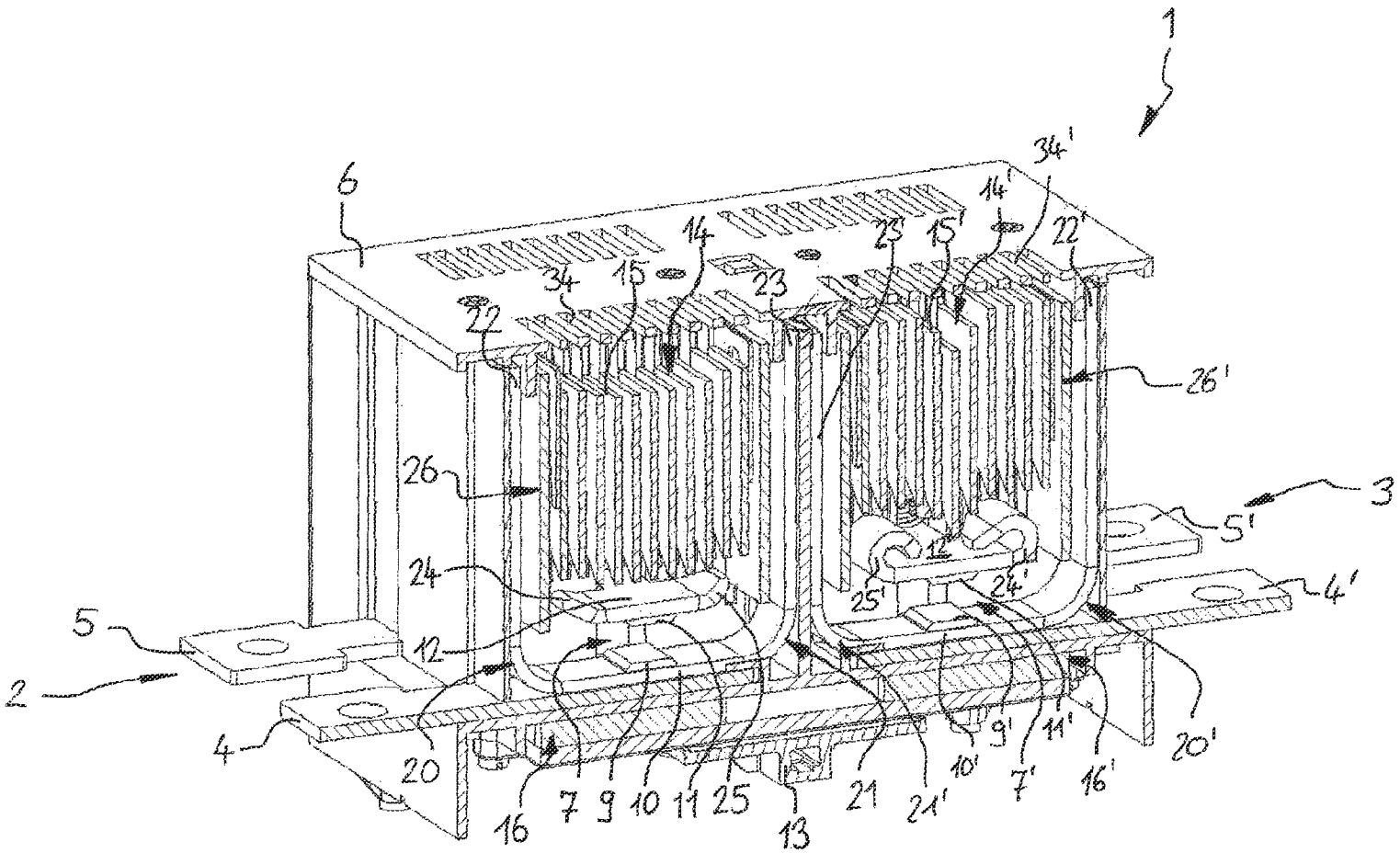
FIG. 1 shows a perspective longitudinal section through a switching device according to the invention.

An aspect of the invention provides a a switching device suitable for direct current operation, which includes at least one contact pair with a first contact and a second contact, at least one of the two contacts being movable and the two contacts being in contact with one another in a switched-on condition of the switching device and out of contact in a switched-off condition of the switching device. In addition, the switching device includes an arc driver assembly which generates a magnetic field at least in the area of the contact pair, as well as a first arc guide arrangement by means of which an arc arising between the contacts with a first current direction is guided to an extinguishing device for extinguishing the arc.

An aspect of this invention provides a switching device that can be operated independent of polarity and one that is constructed in a simple manner.

An aspect of the invention provides a switching device suited for direct current operation, which includes at least one contact pair with a first contact and a second contact, at least one of the two contacts being movable and the two contacts being in contact with one another in a switched-on state of the switching device and out of contact with one another in a switched-off state of the switching device. In addition, the switching device includes an arc driver assembly which generates a magnetic field at least in the area of the contact pair, as well as a first arc guide arrangement by means of which an arc arising between the contacts with a first current direction is guided to an extinguishing device for extinguishing the arc. Moreover, a second arc routing arrangement is provided by means of which an arc arising between the contacts with a second current direction opposite to the first current direction is driven toward the extinguishing device for extinguishing the arc.

It is advantageous in this case that both arc routing arrangements are so designed that the arc is directed into the same extinguishing device regardless of its current direction. In this case, special insulating separating walls are required, so as to direct the arc into different extinguishing devices or into different areas of one and the same extinguishing device. A permanent magnetic field is preferably generated by permanent magnets, to provide a magnetic field simply and not depending on the current.

The first arc routing arrangement is designed in such a manner that an arc having a first current direction is deflected in a first direction of rotation and guided toward the extinguishing device. The second arc routing arrangement is designed in such a manner that an arc having a second current direction is deflected in a direction of rotation opposite to the first direction of rotation and guided toward the extinguishing device. This means that the arc is deflected and guided toward the extinguishing device regardless of its current direction. In this design, the distances that the arc must travel to reach the extinguishing device are preferably the same, to ensure identical switching characteristics of the switching device in both directions of current.

Preferably, the first contact is an immovable fixed contact and the second contact is a movable contact. In this case, the arc will be deflected around the second contact onto a side of the second contact facing away from the first contact. The arc will thus be deflected onto the back side of the movable contact, the extinguishing device being located on the back side of the movable contact. The arc is driven into the extinguishing device in a direction approximately parallel to the direction of motion of the movable contact. The movable contact moves toward the extinguishing device during opening of the contact pair, so that the arc can be guided into the extinguishing device by the shortest path.

The extinguishing chamber is preferably constructed as a deionising extinguishing chamber with a multitude of extinguishing plates that are electrically insulated from each other and arranged parallel to each other. It is thus possible to use standard components and to preferably provide the extinguishing device as a pre-assembled unit, which can be inserted into the housing of the switching device. In this case, the extinguishing plate are preferably oriented parallel to the direction of motion of the at least one movable contact.

The arc guiding arrangements have, in each case, a first guide plate and a second guide plate, both the first guide plates running outward from the first contact in opposite directions and toward the extinguishing device. The first two guide plates can take up the extinguishing device between themselves. The second guide plates are preferably constructed without breaks, even in the transitions between the fixed bridge contact member and the second guide plates. Stationary arcs, which can lead to burnout and thus to shorter lifespan, are thus prevented.

Both second guide plates are preferably located in a bridge contact member which bears the second contact, where they are able to run in opposite directions. In a first variant of the second guide plates, it is provided that the second guide plates are angled toward the extinguishing device at their free ends. Consequently, the guide plates remain essentially plate-shaped, which simplifies the manufacture of the guide plates. A second variant differs in that the second guide plates are given a ring-shaped bend at their free ends. The second guide plates thus each form a ring section with a large diameter relative to the thickness of the material, so that the arc is more easily deflected. Manufacture, however, is more complicated than in the case of plate-shaped second guide plates.

In a preferred embodiment, the arc driver assembly includes at least one permanent magnet which is arranged between two pole plates, the contact pair being positioned between the pole plates. A magnetic field that is as homogenous as possible is generated by the two pole plates.

The switching device can be configured as a double-throw switching device with two contact pairs, the two contact pairs each having a first contact and a second contact. In this case, the second contacts are located on a bridging contact member that is movable with respect to the first contacts. In the switched-on state of the switching device, each of the second contacts is in contact with one of the first contacts, the bridging contact member electrically interconnecting the two second contacts.

Figure 2:
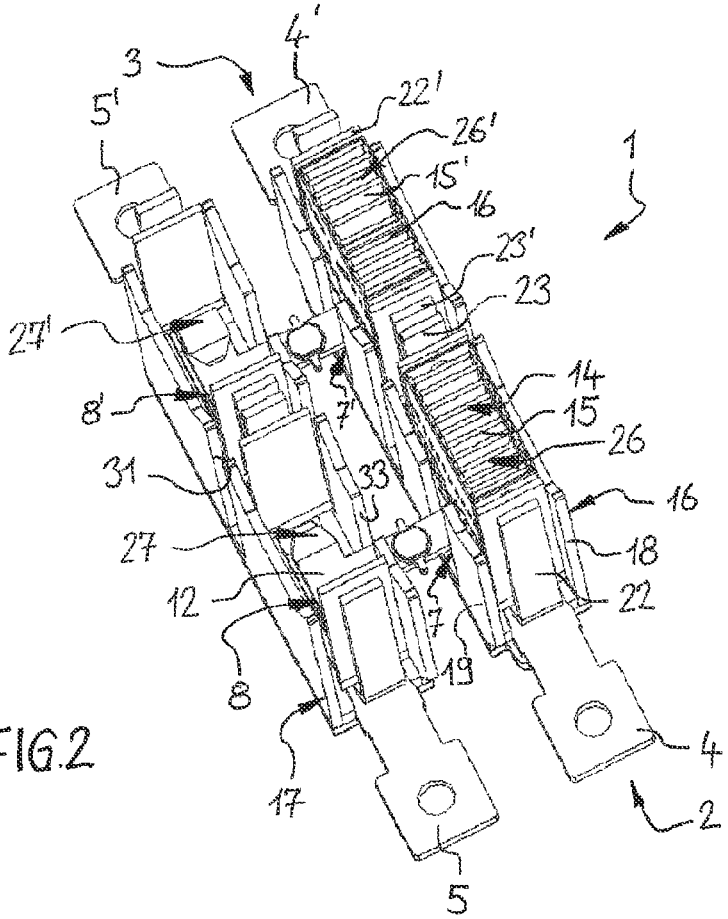
FIG. 2 is a perspective view of the switch arrangement of the switching device according to FIG. 1, without a housing.
Figure 3:
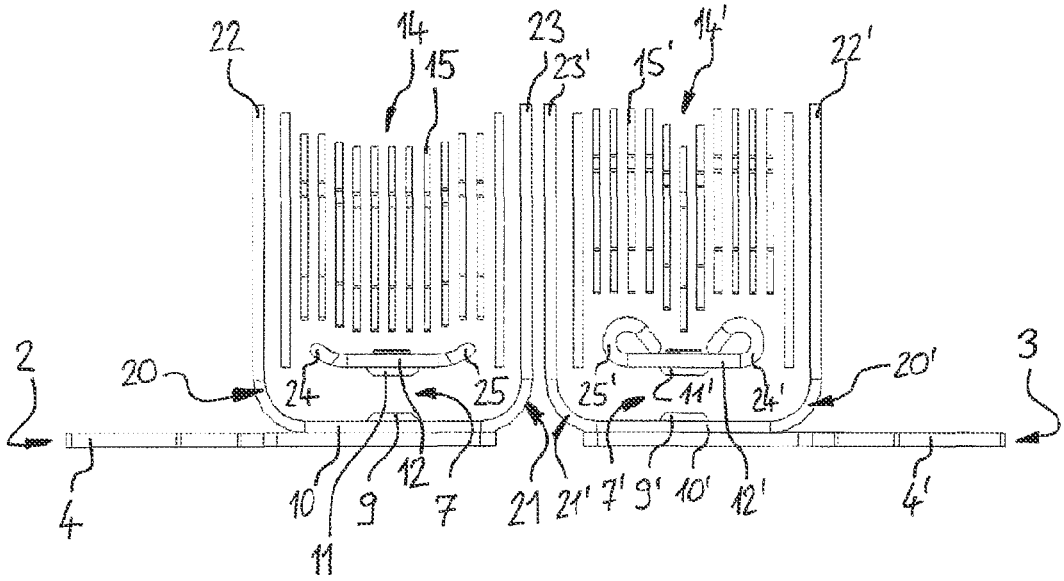
FIG. 3 is a side view of the switch arrangement of the switching device in a simplified presentation.

FIGS. 1 through 3 show the switching device 1 according to the invention in perspective views, a housing 6 of the switching device not being shown in FIG. 2 for the sake of clarity and the arc driver arrangement also being left out of FIG. 3. FIGS. 1 through 3 are presented jointly hereafter.

The electrical switching device 1 comprises a total of two poles, i.e. two switching paths, namely a first switching path 2 and a second switching path 3. Both the switching paths 2, 3 are each provided with a switching device, as described in detail below, and can thus be electrically cut off. Both switching paths 2, 3 can each be integrated into a direct current circuit and can be used to interrupt the current flow. In FIG. 1, the first switching path 2 is shown on the left, and the second switching path 3 is shown on the right. Hereafter, the first switching path 2 will be representatively explained, the second switching path 3 being constructed essentially identically as a mirror image. Differences will be explained later. In the present case, both switching paths 2, 3 are differently constructed with regard to arc guiding and extinguishing. To clarify the two variants, both variants were shown in the switching device 1. The switches can, however, be built fully identical.

The switching device 1 includes a housing 6, in which the switches are incorporated as described hereafter in more detail. The first switching path 2 comprises a first connection 4 and a second connection 5 for the purpose of connecting the first current path 2 with the terminals of a direct current circuit. The two connections 4, 5 are routed out of the same side of the housing 6, with the same orientation. The first connection 4 leads to a first contact pair 7, which is located in a first switching chamber 26 of the housing 6. The second connection 5 leads to a second contact pair 8, which is located in a second switching chamber 27 of the housing 6. The two switching chamber 26, 27 are positioned next to one another in the housing 6, electrically isolated from each other. The first connection 4 is electrically connected to a first fixed contact support 10 on which is located a first contact 9 of the first contact pair 7. A second contact 11 is arranged movable relative to a first contact 9. The second contact 11 is vertically adjustable in the view shown in FIG. 1. The second contact 11 is provided on an electrically conducting contact support in the form of a bridging contact member 12, which is adjustable by means of a switching bridge 13. In a switched-on state, the first contact 9 and the second contact 11 are kept in contact with each other. In a switched-off state shown in FIG. 1, both contacts 9, 11 are kept out of contact with one another. The bridging contact member 12 also carries a second contact, covered here and thus not visible, of the second contact pair 8, the bridging contact member 12 electrically interconnecting the two second contacts 11. The second contact of the second contact pair 8 is adjustable with respect to a first contact of the second contact pair 8 by means of the bridging contact member 12 and the switching bridge 13, the first contact of the second contact pair 9 being positioned on a second fixed contact support which is electrically connected with the second connection 5. By adjusting the switch bridge 13, the first switching path 2 is thus closed or opened at will at both contact pairs 7, 8.

When shifting switching bridge 13 into an open position, arcs can form between the contacts 9, 11 of the two contact pairs 7, 8, which must be extinguished. To this end, a first extinguishing device 14 is provided vertically above the first contact pair 7, and second extinguishing device, not shown here for the sake of clarity, vertically above the second contact pair 8, the two extinguishing devices 14 being of identical construction. The first extinguishing device 14 is positioned on a side of the bridging contact member 12 facing away from the first contact 9. The first extinguishing device 14 includes first extinguishing plates 15 which are arranged parallel to one another and run parallel to the direction of adjustment of the bridging contact member 12.

Figure 4:
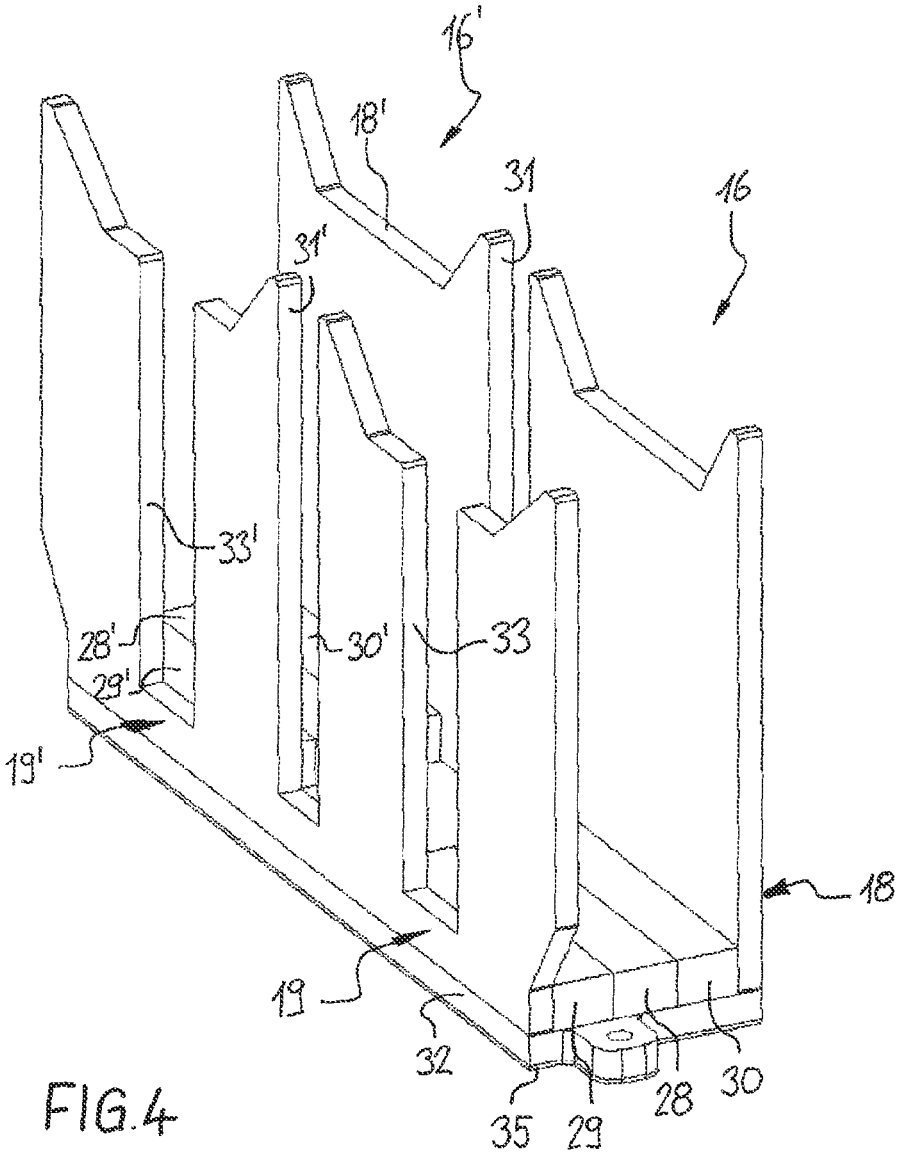
FIG. 4 is an arc driver arrangement for a switching device according to FIG. 1.

A first arc driver assembly 16 is provided in order to be able to move an arc that forms between the first contacts 9 and the second contact 11 toward the first extinguishing device 14. A second arc driver assembly 17 is provided in order to be able to drive an arc that forms between the contacts of the second contact pair 8 into the second extinguishing device. FIG. 4 shows by way of an example the first arc driver assembly 16, which has a permanent magnet 28. The permanent magnet 28 is positioned between two flux conductors 29, 30 running parallel to the permanent magnets 28. The flux conductors 29, 30 and the permanent magnet 28 are in turn located between an outer pole plate 18 and an inner pole plate 19. Overall, the first arc driver assembly 16 has an essentially U-shaped profile. In addition, the inner pole plate 19 which faces the inside of the switching device 1 and is located in proximity to the second arc driver assembly 17, has a slot 33 through which the bridging contact member 12 is routed to as to interconnect the second contacts 11 of the two contact pairs 7, 8 positioned between the pole plates 18, 19.

Moreover, the first arc driver assembly 16 is made in one piece with another first arc driver assembly 16' for the second switching path 3, the two first arc driver assemblies 16, 16' being of mirror-image construction with respect to a transverse plane of the switching device 1. The arc drive assemblies 16, 16' of the two current paths 2, 3 thus constitute a component which can be pre-assembled. The outer pole plates 18, 18' and the inner pole plates 19, 19' of the two first arc driver assemblies 16, 16' each consist of a common plate, but are separated from one another by a separation slot 31. This separation serves to homogenise the magnetic fields of the individual arc driver assemblies. Otherwise, a magnetic field would form in the middle of the plates, that is in the transition from one arc driver assembly 16 to the other arc drive assembly 16', that is stronger than at the outer edges.

A continuous plate-shaped spacer 32 made of electrically insulating material, is provided underneath the permanent magnets 28, 28'. In addition, a shield plate 35 is provided, on the side of the spacer 32 facing away from the pole plates 18, 18', 19, 19', to provide downward shielding from the magnetic fields generated by the permanent magnets 28, 28'. This is to prevent interference with an actuating device for actuating the switching bridge 13. Indeed, an actuating device, which includes a magnetic switching coil, is provided as a rule below the switching device 1, so that the permanent magnet fields of the arc driver assemblies could negatively influence the switching behaviour of the switching coil.

The arc guiding arrangements 20, 21 of the two contact pairs 7, 8 are of identical construction, reference being made hereafter to the arc guiding arrangement 20, 21 of the first contact pair 7. A first arc guiding arrangement 20 and a second arc guiding arrangement 21 are provided on first contact pair 7. The first arc guiding assembly 20 is used for guiding an arc with a first current direction. The second arc guiding assembly 21 is used for guiding an arc with a second current direction. Due to the magnetic field forming homogeneously between the pole plates 18, 19 from one pole plate 18, 19 to the other pole plate 19, 18 and thus a Lorentz force perpendicular to an arc which forms between the first contact 9 and the second contact 11 is exerted on the arc. The arc is then driven to the right or to the left, depending on the current direction, as shown in FIG. 1. If the arc is driven to the left as shown in FIG. 1, a first guide plate 22 and a second guide plate 24 serve to drive the arc into the first extinguishing device 14. The first guide plate 22 is connected to the first fixed contact support 10 and runs initially in the orientation of the switching device 1 shown in FIG. 1, horizontally to the left, and is then deflected 90° and leads vertically upward. The second guide plate 24 is formed on the bridging contact member 12 and leads to the left, with a slight upward bend. The arc thus further develops between these two guide plates 22, 24 and is deflected 90° upward. The arc will run further along the rear side of the bridging contact member 12 facing away from the first contact 9, where the arc is successively driven into the gaps between the individual first extinguishing plates 15. Exhaust openings 34 for exhausting the arc gases are provided on a top side of the housing 6.

If the arc has a different current direction, it will be driven to the right, the second arc guiding arrangement 21 being of mirror image construction with respect to a transverse plane compared with the arc guiding arrangement 20. Thus a first guide plate 23 leads initially to the right from the first fixed contact support 10, and is then angled 90° upward. Likewise, a second guide plate 25, which is formed by the bridging contact member 12, is slightly bent upward, so that an arc is first driven sideways to the right and is then deflected upward. Running further, the arc on the rear side of the bridging contact member 12 is driven onto a side facing away from the first contact 9 and there guided successively between the first extinguishing plates 15.

The first fixed contact support 10 and the first guide plates 22, 23 are of U-shaped construction, the first guide plates 22, 23 being constructed parallel and straight at their ends. In this area, the two first guide plates 22, 23 take up the first extinguishing device 14 between them, the extinguishing plates 15 being arranged parallel to the free ends of the first guide plates 22, 23.

The arc guiding arrangements 20, 21 and the first extinguishing device for the first contact pair 7 are of identical construction to the arc guiding arrangements and the second extinguishing device for the second contact pair 8.

The arc guiding arrangements 20', 21' of the second switching path 3 are constructed on the same principle as the arc guiding arrangements 20, 21, of the first switching path 2. Components having the same function are given the same reference symbol, but supplemented with a superscript prime marker. The second switching path 3 differs in the example shown only with respect to the second guide plates 24', 25'. This other embodiment of the second guide plates 24', 25' is integrated into the same switching device 1 for the sake of simplifying the representation. In practice, only one version of the second guide plates 24, 14', 25, 25' would preferably be built into one switching device 1. The second guide plates 24', 25' are not built with only an upward bend, but are curved upward to the extent that they abut the bridging contact member 12' on its rear side and thus form closed rings. This is meant to ensure that the arcs can more easily follow the deflection onto the rear side of the bridging contact member 12. The first extinguishing plate 15' of the first extinguishing device 14' are so provided here with regard to their arrangement that they roughly follow on their underside the path of the second guide plates 24', 25'.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE SYMBOLS

1 Switching device
2 First switching path
3 Second switching path
4 First connection
5 Second connection
6 Housing
7 First contact pair
8 Second contact pair
9 First contact
10 First fixed contact support
11 Second contact
12 Bridging contact member
13 Switching bridge
14 First extinguishing device
15 First extinguishing plate
16 First arc driving assembly
17 Second arc driving assembly
18 Outer pole plate
19 Inner pole plate
20 First arc guiding arrangement
21 Second arc guiding arrangement
22 First guide plate
23 First guide plate
24 Second guide plate
25 Second guide plate
26 First switching chamber
27 Second switching chamber
28 Permanent magnet
29 Flux conductor
30 Flux conductor
31 Separating slot
32 Spacer
33 Slot
34 Exhaust opening
35 Shield plate

The invention claimed is:

1. A switching device for direct current operation, the switching device comprising:

a contact pair including a first contact and a second contact, wherein at least one of the two contacts is movable, and the two contacts are in contact with each other in the switched-on state of the switching device and the two contacts are not in contact with each other in the switched-off state of the switching device;

an arc driver assembly configured to generate a magnetic field at least in an area of the contact pair;

a first arc guiding arrangement providing a path for driving a first arc generated between the first and second contacts with a first current direction to two or more extinguishing plates of a set of extinguishing plates configured to extinguish the arc; and a second arc guiding arrangement providing a path for driving a second arc generated between the first and second contacts with a second current direction which is opposite to the first current direction, to the two or more extinguishing plates.

2. The switching device of claim 1, wherein the first arc guiding arrangement is arranged such that the arc with the first current direction is deflected in a first direction of rotation and guided into the set of extinguishing plates, and wherein the second arc guiding arrangement is arranged such that the arc with the second direction of current is deflected in a direction of rotation opposite to the first direction of rotation and guided into the extinguishing chamber.

3. The switching device of claim 1, wherein the first contact is an immovable fixed contact and the second contact is a movable contact, and wherein the arc is deflected around the second contact onto a side of the second contact facing away from the first contact.

4. The switching device of claim 1, wherein the set of extinguishing plates provide a deionizing extinguishing chamber and are arranged parallel to one another and isolated from one another.

5. The switching device of claim 4, wherein the extinguishing plates are oriented parallel to a direction of motion of the movable contact.

6. The switching device of claim 1, wherein the first and second arc guiding arrangements each include a respective first guide plate and a respective second guide plate, wherein the first guide plates extend outward from the first contact in opposite directions from each other.

7. The switching device of claim 6, wherein the first guide plates are break-free.

8. The switching device of claim 6, wherein the set of extinguishing plates is disposed between the first guide plates.

9. The switching device of claim 6, wherein the second guide plates are disposed on a contact support, which carries the second contact.

10. The switching device of claim 9, wherein the second guide plates extend outward from the second contact in opposite directions from each other.

11. The switching device of claim 10, wherein the second guide plates are angled, at their free ends, toward the set of extinguishing plates.

12. The switching device of claim 10, wherein the second guide plates are curved into a ring at their free ends.

13. The switching device of claim 1, wherein the arc guiding arrangement includes a permanent magnet, arranged between two pole plates, and wherein the contact pair is disposed between the two pole plates.

14. The switching device of claim 1, comprising:

at least two contact pairs, each including the first contact and the second contact, making up a double throw switching arrangement, wherein the second contacts are positioned on the first bridging contact member, which is movable with respect to the first contacts, wherein, in the switched-on state of the switching device, the second contacts are in contact with one of the first contacts, and wherein the bridging contact member electrically interconnects the two second contacts.

15. The switching device of claim 1, wherein the set of extinguishing plates is a component of a deionizing extinguishing chamber and are arranged parallel to one another and isolated from one another.

16. The switching device of claim 1, wherein the first arc guiding arrangement providing the path for driving the first arc generated between the first and second contacts with the first current direction includes a first guide plate and a second guide plate, and wherein the second arc guiding arrangement providing a path for driving a second arc generated between the first and second contacts with a second current direction which is opposite to the first current direction includes a third guide plate and a fourth guide plate.

17. The switching device of claim 16, wherein the first and second guide plates initially extend in a first physical direction from the first and second contacts, and wherein the third and fourth guide plates initially extend in a second physical direction from the first and second contacts, the second physical direction being opposite the first physical direction.

18. The switching device of claim 1, wherein the path for driving the first arc generated between the first and second contacts with the first current direction of the first arc guiding arrangement initially extends in a first physical direction, and wherein the path for driving the second arc generated between the first and second contacts with the second current direction of the second arc guiding arrangement initially extends in a second physical direction, the second physical direction being opposite the first physical direction.

19. The switching device of claim 1, wherein the arc driver assembly configured to generate a magnetic field at least in an area of the contact pair comprises a permanent magnet.

20. The switching device of claim 1, wherein the arc driver assembly configured to generate a magnetic field at least in an area of the contact pair that is independent of a direction of current flowing in the switching device.

* * * * *